US011523240B2

(12) United States Patent
Ithapu et al.

(10) Patent No.: US 11,523,240 B2
(45) Date of Patent: *Dec. 6, 2022

(54) SELECTING SPATIAL LOCATIONS FOR AUDIO PERSONALIZATION

(71) Applicant: Meta Platforms Technologies, LLC, Menlo Park, CA (US)

(72) Inventors: Vamsi Krishna Ithapu, Kirkland, WA (US); William Owen Brimijoin, II, Kirkland, WA (US); Henrik Gert Hassager, Seattle, WA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 37 days.

This patent is subject to a terminal disclaimer.

(21) Appl. No.: 17/219,855

(22) Filed: Mar. 31, 2021

(65) Prior Publication Data

US 2021/0219085 A1 Jul. 15, 2021

Related U.S. Application Data

(63) Continuation of application No. 16/562,228, filed on Sep. 5, 2019, now Pat. No. 10,999,690.

(51) Int. Cl.
*H04S 7/00* (2006.01)

(52) U.S. Cl.
CPC ..... *H04S 7/301* (2013.01); *H04S 7/303* (2013.01); *H04S 2420/01* (2013.01)

(58) Field of Classification Search
CPC .. H04S 7/303; H04S 2400/11; H04S 2420/01; G06K 9/00624

(Continued)

(56) References Cited

U.S. PATENT DOCUMENTS 9,955,281 B1 * 4/2018 Lyren ..... H04S 7/304
2012/0070005 A1 * 3/2012 Inou ..... H04S 1/002 381/17

(Continued)

FOREIGN PATENT DOCUMENTS

EP 3509327 A1 7/2019

OTHER PUBLICATIONS

Lee, G. W. et al. "Personalized HRTF Modeling Based on Deep Neural Network Using Anthropometric Measurements and Images of the Ear." Applied Sciences, vol. 8, No. 11, Nov. 2018, pp. 1-14.

(Continued)

*Primary Examiner* — William A Jerez Lora
(74) *Attorney, Agent, or Firm* — Fenwick & West LLP

(57) ABSTRACT

An audio system generates customized head-related transfer functions (HRTFs) for a user. The audio system receives an initial set of estimated HRTFs. The initial set of HRTFs may have been estimated using a trained machine learning and computer vision system and pictures of the user's ears. The audio system generates a set of test locations using the initial set of HRTFs. The audio system presents test sounds at each of the initial set of test locations using the initial set of HRTFs. The audio system monitors user responses to the test sounds. The audio system uses the monitored responses to generate a new set of estimated HRTFs and a new set of test locations. The process repeats until a threshold accuracy is achieved or until a set period of time expires. The audio system presents audio content to the user using the customized HRTFs.

20 Claims, 6 Drawing Sheets

(58) Field of Classification Search
USPC ..... 381/56, 58, 124, 303
See application file for complete search history.

(56) References Cited

U.S. PATENT DOCUMENTS

| | | | | |
|---|---|---|---|---|
| 2018/0041837 | A1* | 2/2018 | Woelfl | H04R 1/026 |
| 2018/0310115 | A1 | 10/2018 | Romigh | |

OTHER PUBLICATIONS

PCT International Search Report and Written Opinion, PCT Application No. PCT/US2020/045534, dated Feb. 11, 2021, 11 pages.
International Preliminary Report on Patentability for International Application No. PCT/US2020/045534, dated Mar. 17, 2022, 10 pages.

* cited by examiner

SELECTING SPATIAL LOCATIONS FOR AUDIO PERSONALIZATION

CROSS REFERENCE TO RELATED APPLICATIONS

This application is a continuation of co-pending U.S. application Ser. No. 16/562,228, filed Sep. 5, 2019, which is incorporated by reference in its entirety.

FIELD OF THE INVENTION

This disclosure relates generally to artificial reality systems, and more specifically to audio systems for artificial reality systems.

BACKGROUND

People hear sounds differently. For users of an audio system, such as an audio system in an artificial reality system, the sounds presented by the audio system may be heard differently by different users. Audio systems may analyze images of a user, such as images of the ears of the user, to calculate head-related transfer functions and customize the sounds presented to the user.

SUMMARY

An audio system generates or receives an initial set of head-related transfer functions (HRTFs) for a user. The initial set of HRTFs may have been estimated using a trained machine learning and computer vision system and images (e.g., of the user's ears, head, etc.). The audio system generates a set of test locations using the initial set of HRTFs. The audio system presents audio content at each of the initial set of test locations using the initial set of HRTFs. The audio system monitors responses of the user to the audio content presented for each of the set of test locations. The audio system uses the monitored responses to generate a new set of estimated HRTFs and a new set of test locations. The process may repeat until a threshold accuracy is achieved, until a set period of time expires, until a set number of iterations is achieved, etc.

In some embodiments, a method may comprise selecting a set of test locations for a set of estimated head-related transfer functions (HRTFs) of a user. A set of customized HRTFs for the user is generated, the generating based in part on applying an iterative process to the set of estimated HRTFs. The iterative process may be repeated until a quality metric is met. Content is presented to the user using the customized set of HRTFs. The iterative process may comprise, e.g., generating test sounds for the set of test locations. The generated test sounds are spatialized using the estimated HRTFs of the user. The iterative process may also include determining accuracy values for the estimated HRTFs of the user based in part on responses of the user to the generated test sounds and updating the estimated HRTFs of the user based in part on the accuracy values. The iterative process may also include adjusting the set of test locations based in part on the updated estimated HRTFs.

In some embodiments, a method may comprise selecting a first set of test locations based on a first set of estimated head-related transfer functions (HRTFs) of a user. Test sounds are generated for the first set of test locations, and accuracy values are calculated for the first set of estimated HRTFs of the user based on a user response to the test sounds for the first set of test locations. A second set of HRTFs is calculated for the user based on the accuracy values for the first set of estimated HRTFs. A second set of test locations is selected based on the second set of HRTFs, and test sounds are generated for the second set of test locations.

Figure 1A:
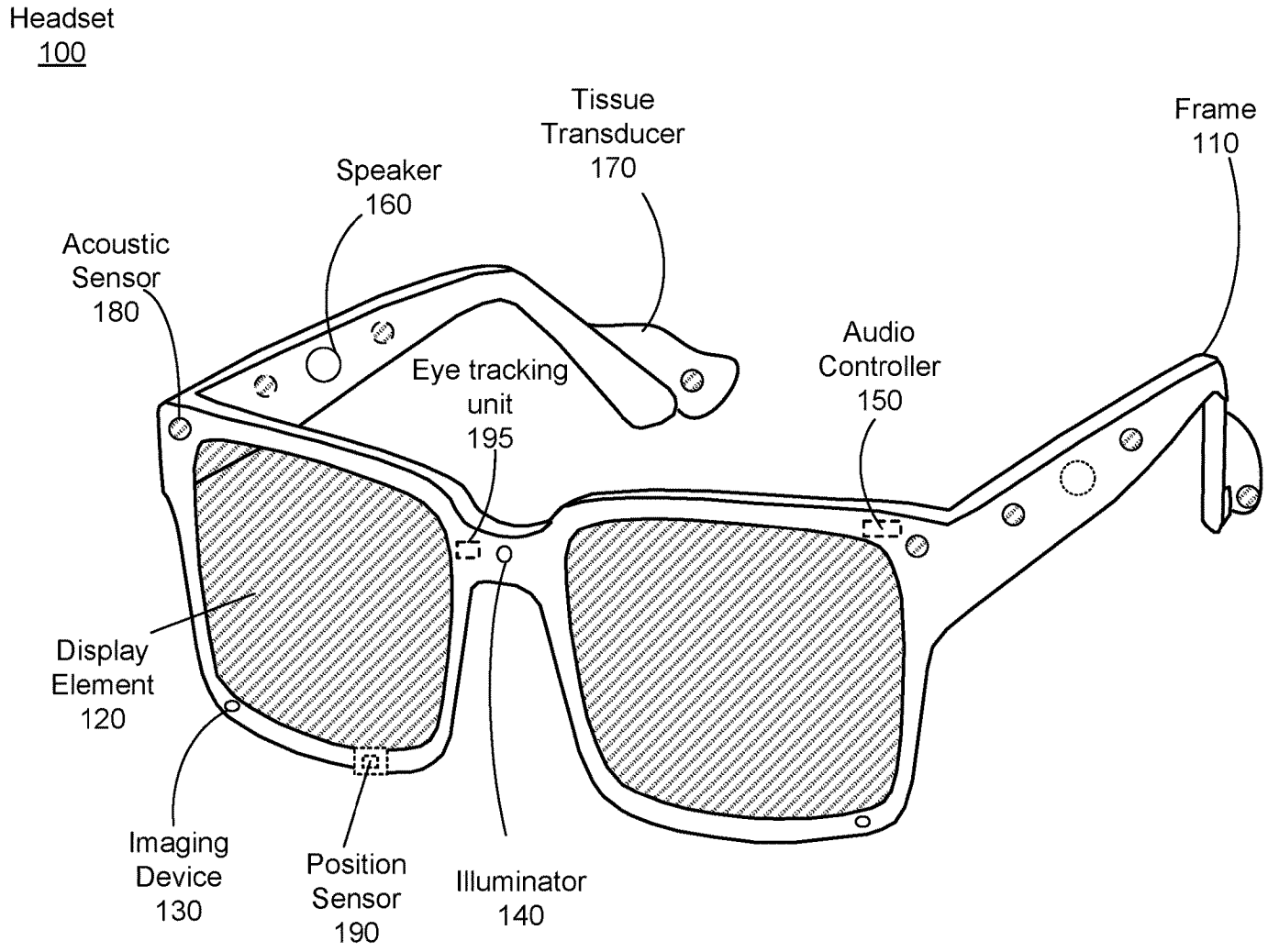
FIG. 1A is a perspective view of a headset implemented as an eyewear device, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

A headset includes an audio system that utilizes customized head-related transfer functions (HRTFs) for a user to present sounds to the user. The audio system uses an iterative process to refine the HRTFs for the user. The iterative process may include actively or passively obtaining user feedback to sounds presented using the HRTFs.

The audio system generates or receives an initial set of HRTFs for a user. The initial set of HRTFs may have been estimated using a trained machine learning and computer vision system and a description of the user, which may include pictures of the user's head, torso, or ears, or physical summaries or measurements of ears referred to as anthropometric features. The audio system generates a set of test locations using the initial set of HRTFs. The test locations may be selected to be located at locations where the HRTFs change significantly as a function of position, which may indicate a relatively high level of uncertainty in the HRTFs in that region, or that small inaccuracies in HRTFs may result in significant errors in sounds presented to the user. The audio system presents audio content at each of the initial set of test locations using the initial set of HRTFs. The audio system monitors responses of the user to the audio content presented for each of the set of test locations. The responses may include a gaze direction, a head movement, a spoken response, or any other suitable detectable response from the user. The audio system may detect the responses using sensors, such as cameras, motions sensors, and/or microphones. The audio system uses the monitored responses to generate a new set of estimated HRTFs and a new set of test locations. The process may repeat until a threshold accuracy is achieved or until a set period of time expires.

It may be difficult to obtain accurate HRTFs for all possible sound source locations. However, by selecting test locations in regions where HRTFs are known a priori to be very sensitive, the audio system may decrease the time and computational demands to improve the HRTF estimates in locations more likely to contain inaccurate estimated HRTFs. The disclosed audio system and HRTF customization process allows the audio system to accurately calculate HRTFs for a user without using active measurements of HRTFs using external audio equipment. Additionally, the iterative process of refining the HRTFs based on active or passive user feedback allows the audio system to obtain more accurate HRTFs in comparison to systems which use a static set of estimated HRTFs.

Embodiments of the invention may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to create content in an artificial reality and/or are otherwise used in an artificial reality. The artificial reality system that provides the artificial reality content may be implemented on various platforms, including a wearable device (e.g., headset) connected to a host computer system, a standalone wearable device (e.g., headset), a mobile device or computing system, or any other hardware platform capable of providing artificial reality content to one or more viewers.

FIG. 1A is a perspective view of a headset 100 implemented as an eyewear device, in accordance with one or more embodiments. In some embodiments, the eyewear device is a near eye display (NED). In general, the headset 100 may be worn on the face of a user such that content (e.g., media content) is presented using a display assembly and/or an audio system. However, the headset 100 may also be used such that media content is presented to a user in a different manner. Examples of media content presented by the headset 100 include one or more images, video, audio, or some combination thereof. The headset 100 includes a frame, and may include, among other components, a display assembly including one or more display elements 120, a depth camera assembly (DCA), an audio system, and a position sensor 190. While FIG. 1A illustrates the components of the headset 100 in example locations on the headset 100, the components may be located elsewhere on the headset 100, on a peripheral device paired with the headset 100, or some combination thereof. Similarly, there may be more or fewer components on the headset 100 than what is shown in FIG. 1A.

The frame 110 holds the other components of the headset 100. The frame 110 includes a front part that holds the one or more display elements 120 and end pieces (e.g., temples) to attach to a head of the user. The front part of the frame 110 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 120 provide light to a user wearing the headset 100. As illustrated the headset includes a display element 120 for each eye of a user. In some embodiments, a display element 120 generates image light that is provided to an eyebox of the headset 100. The eyebox is a location in space that an eye of user occupies while wearing the headset 100. For example, a display element 120 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 100. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 120 are opaque and do not transmit light from a local area around the headset 100. The local area is the area surrounding the headset 100. For example, the local area may be a room that a user wearing the headset 100 is inside, or the user wearing the headset 100 may be outside and the local area is an outside area. In this context, the headset 100 generates VR content. Alternatively, in some embodiments, one or both of the display elements 120 are at least partially transparent, such that light from the local area may be combined with light from the one or more display elements to produce AR and/or MR content.

In some embodiments, a display element 120 does not generate image light, and instead is a lens that transmits light from the local area to the eyebox. For example, one or both of the display elements 120 may be a lens without correction (non-prescription) or a prescription lens (e.g., single vision, bifocal and trifocal, or progressive) to help correct for defects in a user's eyesight. In some embodiments, the display element 120 may be polarized and/or tinted to protect the user's eyes from the sun.

Note that in some embodiments, the display element 120 may include an additional optics block (not shown). The optics block may include one or more optical elements (e.g., lens, Fresnel lens, etc.) that direct light from the display element 120 to the eyebox. The optics block may, e.g., correct for aberrations in some or all of the image content, magnify some or all of the image, or some combination thereof.

The DCA determines depth information for a portion of a local area surrounding the headset 100. The DCA includes one or more imaging devices 130 and a DCA controller (not shown in FIG. 1A), and may also include an illuminator 140. In some embodiments, the illuminator 140 illuminates a portion of the local area with light. The light may be, e.g., structured light (e.g., dot pattern, bars, etc.) in the infrared (IR), IR flash for time-of-flight, etc. In some embodiments, the one or more imaging devices 130 capture images of the portion of the local area that include the light from the illuminator 140. As illustrated, FIG. 1A shows a single illuminator 140 and two imaging devices 130. In alternate embodiments, there is no illuminator 140 and at least two imaging devices 130.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 140), some other technique to determine depth of a scene, or some combination thereof.

The audio system provides audio content. The audio system includes a transducer array, a sensor array, and an audio controller 150. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers. A transducer may be a speaker 160 or a tissue transducer 170 (e.g., a bone conduction transducer or a cartilage conduction transducer). Although the speakers 160 are shown exterior to the frame 110, the speakers 160 may be enclosed in the frame 110. In some embodiments, instead of individual speakers for each ear, the headset 100 includes a speaker array comprising multiple speakers integrated into the frame 110 to improve directionality of presented audio content. The tissue transducer 170 couples to the head of the user and directly vibrates tissue (e.g., bone or cartilage) of the user to generate sound. The number and/or locations of transducers may be different from what is shown in FIG. 1A.

The sensor array detects sounds within the local area of the headset 100. The sensor array includes a plurality of acoustic sensors 180. An acoustic sensor 180 captures sounds emitted from one or more sound sources in the local area (e.g., a room). Each acoustic sensor is configured to detect sound and convert the detected sound into an electronic format (analog or digital). The acoustic sensors 180 may be acoustic wave sensors, microphones, sound transducers, or similar sensors that are suitable for detecting sounds.

In some embodiments, one or more acoustic sensors 180 may be placed in an ear canal of each ear (e.g., acting as binaural microphones). In some embodiments, the acoustic sensors 180 may be placed on an exterior surface of the headset 100, placed on an interior surface of the headset 100, separate from the headset 100 (e.g., part of some other device), or some combination thereof. The number and/or locations of acoustic sensors 180 may be different from what is shown in FIG. 1A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 100.

The audio controller 150 processes information from the sensor array that describes sounds detected by the sensor array. The audio controller 150 may comprise a processor and a computer-readable storage medium. The audio controller 150 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 160, or some combination thereof.

The position sensor 190 generates one or more measurement signals in response to motion of the headset 100. The position sensor 190 may be located on a portion of the frame 110 of the headset 100. The position sensor 190 may include an inertial measurement unit (IMU). Examples of position sensor 190 include: one or more accelerometers, one or more gyroscopes, one or more magnetometers, another suitable type of sensor that detects motion, a type of sensor used for error correction of the IMU, or some combination thereof. The position sensor 190 may be located external to the IMU, internal to the IMU, or some combination thereof.

In some embodiments, the headset 100 may provide for simultaneous localization and mapping (SLAM) for a position of the headset 100 and updating of a model of the local area. For example, the headset 100 may include a passive camera assembly (PCA) that generates color image data. The PCA may include one or more RGB cameras that capture images of some or all of the local area. In some embodiments, some or all of the imaging devices 130 of the DCA may also function as the PCA. The images captured by the PCA and the depth information determined by the DCA may be used to determine parameters of the local area, generate a model of the local area, update a model of the local area, or some combination thereof. Furthermore, the position sensor 190 tracks the position (e.g., location and pose) of the headset 100 within the room.

The headset 100 comprises an eye tracking unit 195. The eye tracking unit 195 may include one or cameras which capture images of the user's eyes. The eye tracking unit 195 may further comprise one or more illuminators that illuminate the user's eyes. The eye tracking unit 195 estimates the angular orientation of the user's eye or eyes. In some embodiments, the eye tracking unit 195 may detect distortions in an illumination pattern projected by the illuminators to determine the angular orientation of the user's eyes. The orientation of the eyes corresponds to the direction of the user's gaze within the headset 100. The orientation of the user's eye may be the direction of the foveal axis, which is the axis between the fovea (an area on the retina of the eye with the highest concentration of photoreceptors) and the center of the eye's pupil. In general, when a user's eyes are fixed on a point, the foveal axes of the user's eyes intersect that point. The pupillary axis is another axis of the eye which is defined as the axis passing through the center of the pupil which is perpendicular to the corneal surface. The pupillary axis does not, in general, directly align with the foveal axis. Both axes intersect at the center of the pupil, but the orientation of the foveal axis is offset from the pupillary axis by approximately −1° to 8° laterally and ±4° vertically. Because the foveal axis is defined according to the fovea, which is located in the back of the eye, the foveal axis can be difficult or impossible to detect directly in some eye tracking embodiments. Accordingly, in some embodiments, the orientation of the pupillary axis is detected and the foveal axis is estimated based on the detected pupillary axis. However, in some embodiments the orientation of the pupillary axis may be used to estimate the angular orientation of the user's eye or eyes without adjusting for the foveal axis difference.

In general, movement of an eye corresponds not only to an angular rotation of the eye, but also to a translation of the eye, a change in the torsion of the eye, and/or a change in shape of the eye. The eye tracking unit 195 may also detect translation of the eye: i.e., a change in the position of the eye relative to the eye socket. In some embodiments, the translation of the eye is not detected directly, but is approximated based on a mapping from a detected angular orientation. Translation of the eye corresponding to a change in the eye's position relative to the detection components of the eye tracking unit may also be detected. Translation of this type may occur, for example, due to shift in the position of the headset 100 on a user's head. The eye tracking unit 195 may also detect the torsion of the eye, i.e., rotation of the eye about the pupillary axis. The eye tracking unit 195 may use the detected torsion of the eye to estimate the orientation of the foveal axis from the pupillary axis. The eye tracking unit 195 may also track a change in the shape of the eye, which may be approximated as a skew or scaling linear transform or a twisting distortion (e.g., due to torsional deformation). The eye tracking unit 195 may estimate the foveal axis based on some combination of the angular orientation of the pupillary axis, the translation of the eye, the torsion of the eye, and the current shape of the eye.

In some embodiments, the eye tracking unit 195 may include at least one emitter which projects a structured light pattern on all or a portion of the eye. This pattern then is then projected onto to the shape of the eye, which may produce a perceived distortion in the structured light pattern when viewed from an offset angle. The eye tracking unit 195 may also include at least one camera which detects the distortions (if any) of the light pattern projected onto the eye. A camera, oriented on a different axis than the emitter, captures the illumination pattern on the eye. This process is denoted herein as "scanning" the eye. By detecting the deformation of the illumination pattern on the surface of the eye, the eye tracking unit 195 can determine the shape of the portion of the eye scanned. The captured distorted light pattern is therefore indicative of the 3D shape of the illuminated portion of the eye. By deriving the 3D shape of the portion of the eye illuminated by the emitter, the orientation of the eye can be derived. The eye tracking unit can also estimate the pupillary axis, the translation of the eye, the torsion of the eye, and the current shape of the eye based on the image of the illumination pattern captured by the camera.

In other embodiments, any suitable type of eye tracking system may be utilized. For example, the eye tracking unit 195 may capture images of the eyes, capture stereo images of the eyes, may utilize a ring of LEDs around the eyes which emit light in a sequence and determine eye orientation based on reflections from the LEDs, may utilize time-of-flight measurements, etc.

As the orientation may be determined for both eyes of the user, the eye tracking unit 195 is able to determine where the user is looking. The headset 100 can use the orientation of the eye to, e.g., determine an inter-pupillary distance (IPD) of the user, determine gaze direction, introduce depth cues (e.g., blur image outside of the user's main line of sight), collect heuristics on the user interaction in the VR media (e.g., time spent on any particular subject, object, or frame as a function of exposed stimuli), some other function that is based in part on the orientation of at least one of the user's eyes, or some combination thereof. Determining a direction of a user's gaze may include determining a point of convergence based on the determined orientations of the user's left and right eyes. A point of convergence may be the point that the two foveal axes of the user's eyes intersect (or the nearest point between the two axes). The direction of the user's gaze may be the direction of a line through the point of convergence and though the point halfway between the pupils of the user's eyes. Additional details regarding the components of the headset 100 are discussed below in connection with FIG. 5.

The audio system calibrates customizes HRTFs for the user. The audio system synthesizes sounds at test locations using an initial set of estimated HRTFs. The eye tracking unit 195 detects a gaze location of the user's eyes in response to the synthesized sounds. The audio system measures an accuracy of the HRTFs used to synthesize the sounds based on user responses, such as differences between the gaze locations and the test locations. The audio system calculates a new set of HRTFs based on the accuracy of the HRTFs. The audio system adjusts the test locations and calculates the accuracy of the new HRTFs at the adjusted test locations. The HRTF customization process is further described with reference to FIGS. 2-4.

Figure 1B:
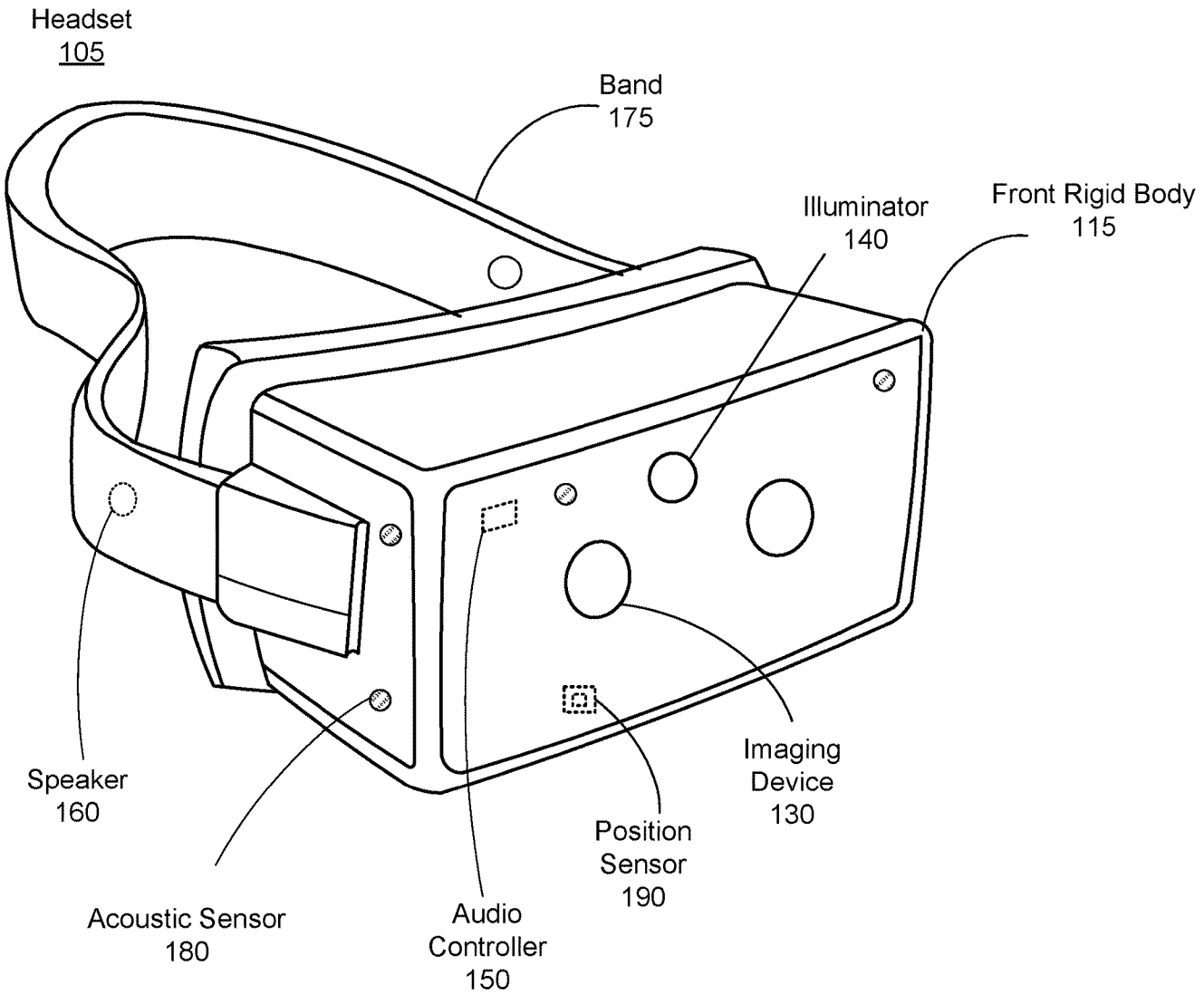
FIG. 1B is a perspective view of a headset implemented as a head-mounted display, in accordance with one or more embodiments.

FIG. 1B is a perspective view of a headset 105 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 115 and a band 175. The headset 105 includes many of the same components described above with reference to FIG. 1A, but modified to integrate with the HMD form factor. For example, the HMD includes a display assembly, a DCA, an audio system, and a position sensor 190. FIG. 1B shows the illuminator 140, a plurality of the speakers 160, a plurality of the imaging devices 130, a plurality of acoustic sensors 180, and the position sensor 190. The speakers 160 may be located in various locations, such as coupled to the band 175 (as shown), coupled to front rigid body 115, or may be configured to be inserted within the ear canal of a user.

Figure 2:
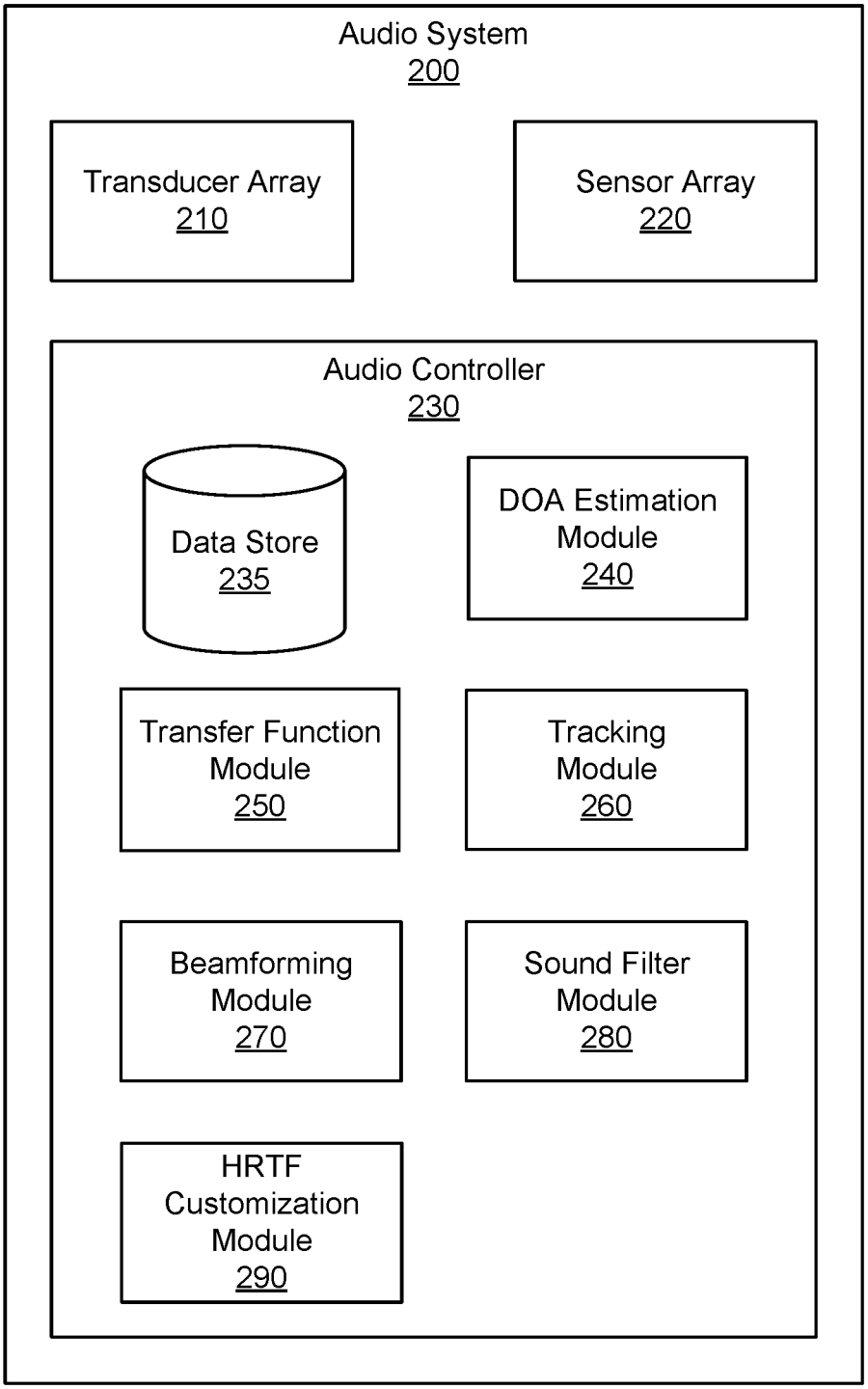
FIG. 2 is a block diagram of an audio system, in accordance with one or more embodiments.

FIG. 2 is a block diagram of an audio system 200, in accordance with one or more embodiments. The audio system in FIG. 1A and/or FIG. 1B may be an embodiment of the audio system 200. The audio system 200 generates one or more acoustic transfer functions for a user. The audio system 200 may then use the one or more acoustic transfer functions to generate audio content for the user. In the embodiment of FIG. 2, the audio system 200 includes a transducer array 210, a sensor array 220, and an audio controller 230. Some embodiments of the audio system 200 have different components than those described here. Similarly, in some cases, functions can be distributed among the components in a different manner than is described here.

The transducer array 210 is configured to present audio content. The transducer array 210 includes a plurality of transducers. A transducer is a device that provides audio content. A transducer may be, e.g., a speaker (e.g., the speaker 160), a tissue transducer (e.g., the tissue transducer 170), some other device that provides audio content, or some combination thereof. A tissue transducer may be configured to function as a bone conduction transducer or a cartilage conduction transducer. The transducer array 210 may present audio content via air conduction (e.g., via one or more speakers), via bone conduction (via one or more bone conduction transducer), via cartilage conduction audio system (via one or more cartilage conduction transducers), or some combination thereof. In some embodiments, the transducer array 210 may include one or more transducers to cover different parts of a frequency range. For example, a piezoelectric transducer may be used to cover a first part of a frequency range and a moving coil transducer may be used to cover a second part of a frequency range.

The bone conduction transducers generate acoustic pressure waves by vibrating bone/tissue in the user's head. A bone conduction transducer may be coupled to a portion of a headset, and may be configured to be behind the auricle coupled to a portion of the user's skull. The bone conduction transducer receives vibration instructions from the audio controller 230, and vibrates a portion of the user's skull based on the received instructions. The vibrations from the bone conduction transducer generate a tissue-borne acoustic pressure wave that propagates toward the user's cochlea, bypassing the eardrum.

The cartilage conduction transducers generate acoustic pressure waves by vibrating one or more portions of the auricular cartilage of the ears of the user. A cartilage conduction transducer may be coupled to a portion of a headset, and may be configured to be coupled to one or more portions of the auricular cartilage of the ear. For example, the cartilage conduction transducer may couple to the back of an auricle of the ear of the user. The cartilage conduction transducer may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

The transducer array 210 generates audio content in accordance with instructions from the audio controller 230. In some embodiments, the audio content is spatialized. Spatialized audio content is audio content that appears to originate from a particular direction and/or target region (e.g., an object in the local area and/or a virtual object). For example, spatialized audio content can make it appear that sound is originating from a virtual singer across a room from a user of the audio system 200. The transducer array 210 may be coupled to a wearable device (e.g., the headset 100 or the headset 105). In alternate embodiments, the transducer array 210 may be a plurality of speakers that are separate from the wearable device (e.g., coupled to an external console). The transducer array 210 generates spatialized sounds that emanate from various test locations.

The sensor array 220 detects sounds within a local area surrounding the sensor array 220. The sensor array 220 may include a plurality of acoustic sensors that each detect air pressure variations of a sound wave and convert the detected sounds into an electronic format (analog or digital). The plurality of acoustic sensors may be positioned on a headset (e.g., headset 100 and/or the headset 105), on a user (e.g., in an ear canal of the user), on a neckband, or some combination thereof. An acoustic sensor may be, e.g., a microphone, a vibration sensor, an accelerometer, or any combination thereof. In some embodiments, the sensor array 220 is configured to monitor the audio content generated by the transducer array 210 using at least some of the plurality of acoustic sensors. Increasing the number of sensors may improve the accuracy of information (e.g., directionality) describing a sound field produced by the transducer array 210 and/or sound from the local area.

The audio controller 230 controls operation of the audio system 200. In the embodiment of FIG. 2, the audio controller 230 includes a data store 235, a DOA estimation module 240, a transfer function module 250, a tracking module 260, a beamforming module 270, a sound filter module 280, and an HRTF customization module 290. The audio controller 230 may be located inside a headset, in some embodiments. Some embodiments of the audio controller 230 have different components than those described here. Similarly, functions can be distributed among the components in different manners than described here. For example, some functions of the controller may be performed external to the headset.

The data store 235 stores data for use by the audio system 200. Data in the data store 235 may include sounds recorded in the local area of the audio system 200, audio content, head-related transfer functions (HRTFs), transfer functions for one or more sensors, array transfer functions (ATFs) for one or more of the acoustic sensors, sound source locations, virtual model of local area, direction of arrival estimates, sound filters, and other data relevant for use by the audio system 200, or any combination thereof.

The data store 235 includes an initial set of estimated HRTFs. The initial set of estimated HRTFs may be generated based on data describing the user. The data describing the user may include descriptions of the physical characteristics of the ears of the user called anthropometric features, images of the user's head or torso, images of the ears of the user, videos of the user, etc. In some embodiments, the data describing the user may include images of the user wearing a headset. The data describing the user may be input to an HRTF machine learning and computer vision module for calculating HRTFs. For example, the data store 235 may provide the dimensions of the user's ears to the HRTF machine learning and computer vision module. The HRTF machine learning and computer vision module may be located on an external server, or the HRTF machine learning and computer vision module may be a component of the HRTF customization module 290. In some cases, the initial set of estimated HRTFs are generated on an external server, and the subsequent iterative refinement of the HRTFs is performed by the audio system 200.

The DOA estimation module 240 is configured to localize sound sources in the local area based in part on information from the sensor array 220. Localization is a process of determining where sound sources are located relative to the user of the audio system 200. The DOA estimation module 240 performs a DOA analysis to localize one or more sound sources within the local area. The DOA analysis may include analyzing the intensity, spectra, and/or arrival time of each sound at the sensor array 220 to determine the direction from which the sounds originated. In some cases, the DOA analysis may include any suitable algorithm for analyzing a surrounding acoustic environment in which the audio system 200 is located.

For example, the DOA analysis may be designed to receive input signals from the sensor array 220 and apply digital signal processing algorithms to the input signals to estimate a direction of arrival. These algorithms may include, for example, delay and sum algorithms where the input signal is sampled, and the resulting weighted and delayed versions of the sampled signal are averaged together to determine a DOA. A least mean squared (LMS) algorithm may also be implemented to create an adaptive filter. This adaptive filter may then be used to identify differences in signal intensity, for example, or differences in time of arrival. These differences may then be used to estimate the DOA. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct path audio signal. Those bins having a portion of the direct-path signal may then be analyzed to identify the angle at which the sensor array 220 received the direct-path audio signal. The determined angle may then be used to identify the DOA for the received input signal. Other algorithms not listed above may also be used alone or in combination with the above algorithms to determine DOA.

In some embodiments, the DOA estimation module 240 may also determine the DOA with respect to an absolute position of the audio system 200 within the local area. The position of the sensor array 220 may be received from an external system (e.g., some other component of a headset, an artificial reality console, a mapping server, a position sensor (e.g., the position sensor 190), etc.). The external system may create a virtual model of the local area, in which the local area and the position of the audio system 200 are mapped. The received position information may include a location and/or an orientation of some or all of the audio system 200 (e.g., of the sensor array 220). The DOA estimation module 240 may update the estimated DOA based on the received position information.

The transfer function module 250 is configured to generate one or more acoustic transfer functions. Generally, a transfer function is a mathematical function giving a corresponding output value for each possible input value. Based on parameters of the detected sounds, the transfer function module 250 generates one or more acoustic transfer functions associated with the audio system. The acoustic transfer functions may be array transfer functions (ATFs), HRTFs, other types of acoustic transfer functions, or some combination thereof. An ATF characterizes how the microphone receives a sound from a point in space.

An ATF includes a number of transfer functions that characterize a relationship between the sound source and the corresponding sound received by the acoustic sensors in the sensor array 220. Accordingly, for a sound source there is a corresponding transfer function for each of the acoustic sensors in the sensor array 220. And collectively the set of transfer functions is referred to as an ATF. Accordingly, for each sound source there is a corresponding ATF. Note that the sound source may be, e.g., someone or something generating sound in the local area, the user, or one or more transducers of the transducer array 210. The ATF for a particular sound source location relative to the sensor array 220 may differ from user to user due to a person's anatomy (e.g., ear shape, shoulders, etc.) that affects the sound as it travels to the person's ears. Accordingly, the ATFs of the sensor array 220 are personalized for each user of the audio system 200.

In some embodiments, the transfer function module 250 determines one or more HRTFs for a user of the audio system 200. The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. In some embodiments, the transfer function module 250 may determine HRTFs for the user using a calibration process. In some embodiments, the transfer function module 250 may provide information about the user to a remote system. The remote system may determine an in initial set of estimated HRTFs that are customized to the user using, e.g., machine learning and computer vision, and provide the customized set of HRTFs to the audio system 200.

The tracking module 260 is configured to track locations of one or more sound sources. The tracking module 260 may compare current DOA estimates and compare them with a stored history of previous DOA estimates. In some embodiments, the audio system 200 may recalculate DOA estimates on a periodic schedule, such as once per second, or once per millisecond. The tracking module may compare the current DOA estimates with previous DOA estimates, and in response to a change in a DOA estimate for a sound source, the tracking module 260 may determine that the sound source moved. In some embodiments, the tracking module 260 may detect a change in location based on visual information received from the headset or some other external source. The tracking module 260 may track the movement of one or more sound sources over time. The tracking module 260 may store values for a number of sound sources and a location of each sound source at each point in time. In response to a change in a value of the number or locations of the sound sources, the tracking module 260 may determine that a sound source moved. The tracking module 260 may calculate an estimate of the localization variance. The localization variance may be used as a confidence level for each determination of a change in movement.

The beamforming module 270 is configured to process one or more ATFs to selectively emphasize sounds from sound sources within a certain area while de-emphasizing sounds from other areas. In analyzing sounds detected by the sensor array 220, the beamforming module 270 may combine information from different acoustic sensors to emphasize sound associated from a particular region of the local area while deemphasizing sound that is from outside of the region. The beamforming module 270 may isolate an audio signal associated with sound from a particular sound source from other sound sources in the local area based on, e.g., different DOA estimates from the DOA estimation module 240 and the tracking module 260. The beamforming module 270 may thus selectively analyze discrete sound sources in the local area. In some embodiments, the beamforming module 270 may enhance a signal from a sound source. For example, the beamforming module 270 may apply sound filters which eliminate signals above, below, or between certain frequencies. Signal enhancement acts to enhance sounds associated with a given identified sound source relative to other sounds detected by the sensor array 220.

The sound filter module 280 determines sound filters for the transducer array 210. In some embodiments, the sound filters cause the audio content to be spatialized, such that the audio content appears to originate from a target region. The sound filter module 280 may use HRTFs and/or acoustic parameters to generate the sound filters. The acoustic parameters describe acoustic properties of the local area. The acoustic parameters may include, e.g., a reverberation time, a reverberation level, a room impulse response, etc. In some embodiments, the sound filter module 280 calculates one or more of the acoustic parameters. In some embodiments, the sound filter module 280 requests the acoustic parameters from a mapping server (e.g., as described below with regard to FIG. 5).

The sound filter module 280 provides the sound filters to the transducer array 210. In some embodiments, the sound filters may cause positive or negative amplification of sounds as a function of frequency.

The HRTF customization module 290 generates customized HRTFs for a user. The HRTF customization module 290 selects a set of test locations for the initial set of estimated HRTFs. The HRTF customization module 290 may select any suitable number of test locations, such as between 25-50 test locations, or between 1-100 test locations. The test locations may be located any direction relative to the user, such as in front of, behind, above, below, to the left, or to the right of the user. The test locations may be located at varying distances to the user.

In some embodiments, the test locations may be selected based on a rate of change of the estimated HRTFs as a function of angle relative to the user. For example, in regions where HRTFs have greatly different values, but are spatially located close to each other, the transfer function module 250 may relatively select more test locations, such that the density of the test locations is based in part on the rate of change of the values of the HRTFs in a given area. The rate of change of HRTF values may be measured using distance computational algorithms. Such algorithms may utilize statistical learning, high dimensional embedding, machine learning and computer vision, parametric modeling, dimensionality reduction, or manifold learning techniques. For instance, a machine learning and computer vision or dimensionality reduction model can be trained to compute distance between HRTFs, or a prescribed set of rules can be enlisted about the signal structure of the HRTF, and an algorithm can compute the distance between two HRTFs using these rules. In some embodiments, the rate of change of HRTF values may be estimated using: a Spectral Difference Estimate (SDE), which is the mean of differences in HRTF spectrum across all audible frequencies; a weighted SDE, in which some frequencies are weighted more or less heavily than averages based on perceptual importance or audibility; or geometric or other distance measures between prominent features in the HRTF. The trained model or the set of rules can be derived ahead of time in an independent study of HRTFs. The resulting distances may be scalar or a set of scalar summaries, and some combination or transformation of these summaries may define whether a given region would benefit from a higher sampling of test locations.

The test locations are provided to the transducer array 210 to generate spatialized sounds that emanate from the test locations. The HRTF customization module 290 instructs the transducer array 210 to generate the spatialized sounds.

The HRTF customization module 290 obtains perceptual feedback from the user for the sounds synthesized at each of the test locations. The sounds may be synthesized sequentially, such that a first sound is synthesized for a first test location, and after receiving perceptual feedback a second sound is synthesized for a second test location, until a response has been received for all test locations. The perceptual feedback comprises a detected response from the user to a synthesized sound for each test location. The perceptual feedback may be captured by one or more sensors on the headset, such as by the eye tracking module, by haptic feedback from a glove, or from a microphone. In some embodiments, the perceptual feedback may be captured by external sensors, such as by the tracking module 560 described with respect to FIG. 5. The perceptual feedback may indicate a perceived location of the synthesized sound. In some embodiments, the perceptual feedback may comprise a gaze direction of the user's eyes, indicating that the user perceived a sound emanating from the gaze direction. The perceptual feedback may comprise a spoken response from the user, such as "front," "back," "left," or "right." The perceptual feedback may comprise a movement by the user, such as the user turning their head or pointing a hand in a direction. The perceptual feedback may comprise selecting one or more answers from a list of choices or answers or entities.

In some embodiments, the perceptual feedback may be obtained in an active calibration process. For example, the headset may inform the user that the HRTFs are being calibrated, and the headset may provide an audio or visual instruction to the user to look in the direction of a perceived sound source.

In some embodiments, the perceptual feedback may be obtained in a passive calibration process, in which the user may be unaware that the HRTFs are being calibrated. For example, the user may be interacting with a headset, such as participating in a virtual reality game, and the HRTF customization module 290 may monitor the user responses to sounds synthesized at test locations during the course of the virtual reality game.

The HRTF customization module 290 compares the perceptual feedback for each test location to the intended location of each test location, and determines an accuracy value for the HRTF at each test location. For example, the HRTF customization module 290 may assign a scalar accuracy value between 1-10, with 10 indicating a highly accurate HRTF and 1 indicating a highly inaccurate HRTF. The accuracy may be determined based on a difference in location between the test location and the perceived sound source location. For example, if the difference between test location and the perceived sound source location is less than 1 degree from the user perspective, the HRTF customization module 290 may assign an accuracy value of 10 to the HRTF at the test location. If the difference between the test location and the perceived sound source location is greater than 90 degrees from the user perspective, the HRTF customization module 290 may assign an accuracy value of 1 to the HRTF at the test location. In some embodiments, the accuracy may be based on radial difference, the radial difference being a difference between a perceived distance from the user to the test location and an intended difference between the user to the test location. In some embodiments, the accuracy may be based on a combination of the radial difference and an angular distance. In some embodiments, this accuracy calculation may not compare the given test response to any correct response, or the correct response may not exist. The test responses may be used to calculate accuracy measured directly without access to any true response.

The HRTF customization module 290 may transmit the accuracy values for the HRTFs to the HRTF machine learning and computer vision module. In some embodiments, the HRTF machine learning and computer vision module may be a component of the HRTF customization module 290, and/or may be component of the headset. However, in some embodiments, the HRTF machine learning and computer vision module may located on an external server, or may be located on a console in communication with the headset.

The HRTF machine learning and computer vision module applies machine learning and computer vision techniques to generate the HRTF model that, when applied to data describing a user, outputs estimated HRTFs for locations relative to the user. The HRTF machine learning and computer vision module may input the accuracy values to an HRTF model and update the estimated HRTFs for the user. The set of initial locations may be predetermined based on ablation studies or independent studies on HRTFs. This may be a set of 1-50 initial locations. The number of initial locations may be fixed ahead of time. The specific locations nevertheless may be user dependent and may be calculated based on the user data including anthropometric features of ears, an image or images or video of left and right ears, or dimensions of head or torso. The set of initial locations may be calculated based on the initial estimation of the HRTF from the user data or may be fixed even before the user data is acquired.

As part of the generation of the HRTF model, the HRTF machine learning and computer vision module forms a training set of HRTFs by identifying a positive training set of HRTFs that have been determined to be accurate, and, in some embodiments, forms a negative training set of HRTFs items that have been determined to be inaccurate. The training set of HRTFs may be obtained via carefully designed acoustic measurements in anechoic or non-anechoic chambers. For each user participating in this training user study, the acoustic measurement of HRTFs can be obtained by placing microphones in left and right ears and generating sounds at different spatial locations around the user. The signals captured by the microphones are then processed using acoustic signal processing techniques to obtain the HRTF of each participant. Such sets of measured HRTFs may be the training set. In some embodiments, the training set may be simulated HRTFs. For each participant in such study, very high-resolution head, torso, and ear scans are obtained. These scans may be captured by widely available 3d mesh capture devices, and the resulting scans will be processed by computer graphics and computer vision methods. The resulting head, torso, and ear processed scans may then be used to simulate HRTFs using Monte Carlo methods or Boundary element or Finite difference time domain or Finite volumes simulation.

The HRTF machine learning and computer vision module uses supervised machine learning and computer vision to train the HRTF model, with the feature vectors of the positive training set and the negative training set serving as the inputs. Different machine learning and computer vision techniques—such as linear support vector machine (linear SVM), boosting for other algorithms (e.g., AdaBoost), neural networks, logistic regression, naïve Bayes, memory-based learning, random forests, bagged trees, decision trees, boosted trees, boosted stumps, nearest neighbors, k nearest neighbors, kernel machines, probabilistic models, conditional random fields, markov random fields, manifold learning, generalized linear models, generalized index models, kernel regression, or Bayesian regression—may be used in different embodiments. The HRTF machine learning and computer vision model, when applied to data describing the user, outputs a set of estimated HRTFs for the user. In some embodiments, the machine learning and computer vision model, when applied to data describing the user, outputs a set of scalars or summaries that can be used to estimate new HRTFs.

The HRTF machine learning and computer vision module extracts feature values from the HRTFs of the training set, the features being variables deemed potentially relevant to whether or not the HRTFs are accurate. Specifically, the feature values extracted by the HRTF machine learning and computer vision module include sound source location, frequency, amplitude, certain statistical irregularities of the signal defined as peak or notch in signal structure, etc. An ordered list of the features for an HRTF is herein referred to as the feature vector for the HRTF. In one embodiment, the HRTF machine learning and computer vision module applies dimensionality reduction (e.g., via linear discriminant analysis (LDA), principle component analysis (PCA), a perceptual feature analysis, or the like) to reduce the amount of data in the feature vectors for HRTFs to a smaller, more representative set of data. In some embodiments, the HRTF machine learning and computer vision module utilizes deep representation learning to extract necessary data for the feature vectors of HRTFs.

The HRTF machine learning and computer vision module provides the updated HRTFs to the audio system 200, and the audio system 200 may test the accuracy of the updated HRTFs. The audio system 200 may iteratively update the HRTFs for the user until a quality metric is met. The iterative process may comprise selecting test locations, producing test sounds at the test locations, receiving feedback for the test sounds, generating updated HRTFs, and selecting new test location based on the updated HRTFs. For example, the audio system 200 may update the HRTFs until all test locations obtain an accuracy value of at least 9 (on a scale of 1-10), or until an average accuracy value is at least 9. In some embodiments, the audio system 200 may iteratively update the HRTFs for a set number of iterations, or for a set period of time, such as for 10 minutes, and the audio system 200 may end calibration of the HRTFs after the expiration of the set number of iterations or after the expiration of the set period of time.

After completion of the iterative HRTF customization process, the HRTF customization module 290 provides a customized set of HRTFs for the user to the audio controller 230. The audio controller 230 uses the customized set of HRTFs to generate spatialized sounds with the transducer array 210 for subsequent audio content provided to the user.

Figure 3:
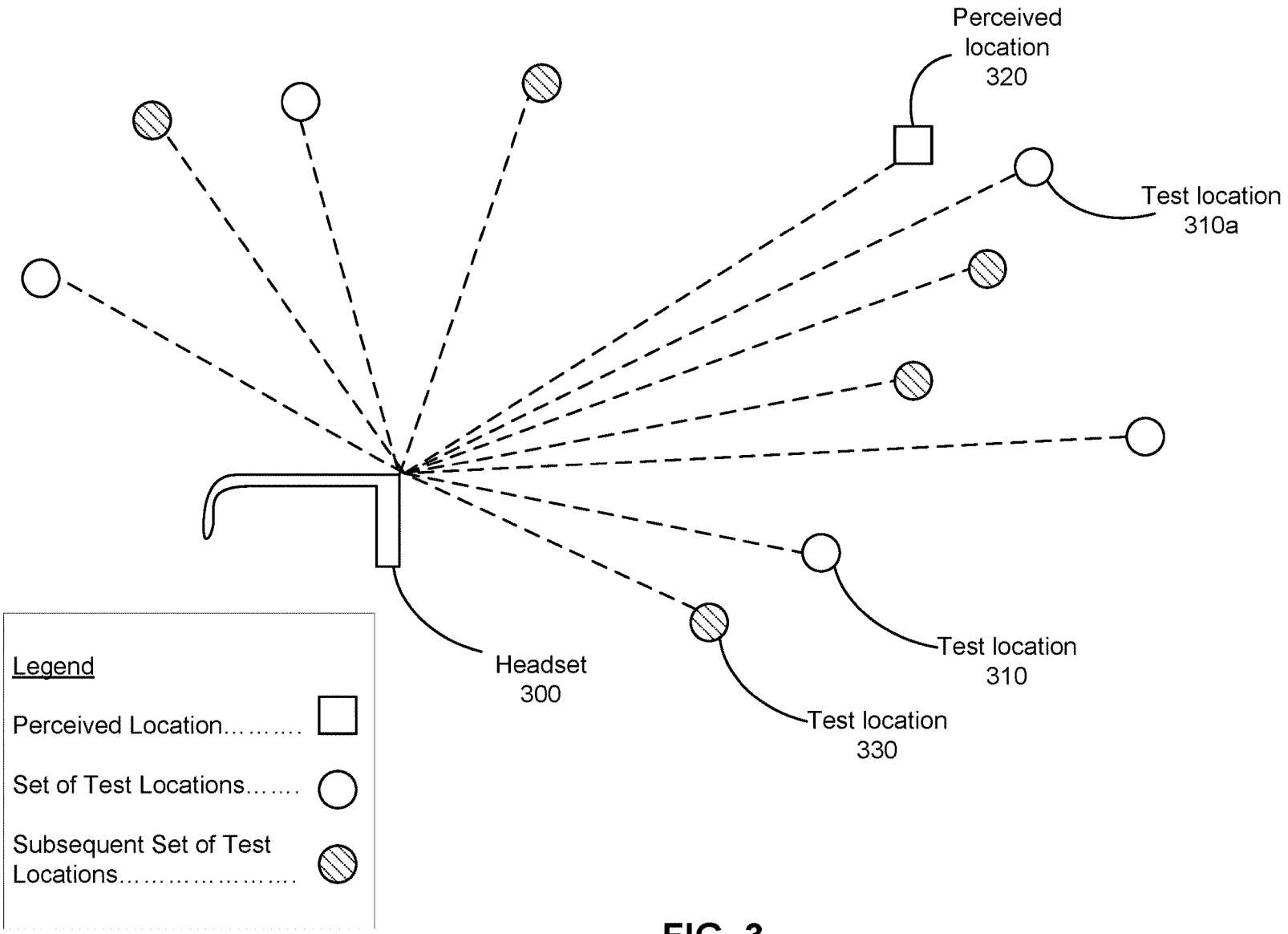
FIG. 3 is a schematic diagram of a headset and multiple test locations, in accordance with various embodiments.

FIG. 3 is a schematic diagram of a headset 300 and multiple test locations, in accordance with one or more embodiments. The headset 100 of FIG. 1A and the headset 105 of FIG. 1B may be embodiments of the headset 300. The headset 300 includes an audio system, such as the audio system 200 of FIG. 2. In some embodiments, an initial set of estimated HRTFs may be generated by an external system and transmitted to the headset 300. In other embodiments, the initial set of estimated HRTFs may be generated by the audio system locally on the headset 300. The initial set of estimated HRTFs may be generated based at least partially on a trained machine learning and computer vision model and images of the user's ears and body.

The headset 300 selects test locations 310 to test the accuracy of the initial set of estimated HRTFs. The test locations 310 may be selected based on the initial set of estimated HRTFs. For example, the test locations 310 may be selected such that a density of the test locations 310 is based on the rate of change of the estimated HRTFs as a function of distance and/or angle. In some embodiments, the test locations 310 may be separated by a minimum perceivable change in direction of arrival, such as by at least 1 degree in azimuth and 5 degrees in elevation.

In some embodiments, the locations where the user's response is captured may be unique to each user. A set of locations may be selected to acquire the user's response based on the initial estimate of HRTFs, and as the user's response is accumulated over time, the set of new locations to test may correspond to regions where HRTFs are more sensitive, noisier, or more discontinuous among the available choice of locations. Among the attributes acquired as a part of the user's feedback, the one or more attributes that drive the choice of locations in these later iterations may also be user dependent. In some embodiments, such attributes may be personalized for the user based on some other simple questions or statistics accumulated from the user, for instance, what user cares about in terms of sound quality, or what sounds the user might listen to more often, etc.

The headset 300 synthesizes audio content for each of the test locations 310 and presents the audio content to the user. The test sounds may correspond to broad band speech or broad band noise or specific sounds that are common in reality. In some embodiments, the test sounds may focus on frequencies between 3 kHz to 10 kHz, or higher.

The headset 300 monitors responses of the user to the audio content for each of the test locations. In some embodiments, the initial set of HRTFs may be based on the user wearing the headset, and in other embodiments, the initial set of HRTFs may be based on the user not wearing the headset. For the former case, predetermined transformation or mapping of change in HRTF signal between no headset and headset is utilized to adjust the HRTF. These predetermined transformations may be computed by ablation studies or other user studies. These predetermined transformations may be specific to an individual, and in some cases they may be also computed using a machine learning and computer vision model that again utilizes user data including anthropometric features, images, or videos of left and right ears.

For example, the headset 300 may track the gaze direction of the user in response to presenting a synthesized sound for the test location 310*a*. The headset 300 may determine, based on the gaze direction, that the user perceived the synthesized sound to originate from the perceived location 320. The difference in location between the test location 310*a* and the perceived location 320 represents an inaccuracy in the estimated HRTF for the test location 310*a*. Based on the monitored responses, the headset 300 generates a new set of estimated HRTFs and a new set of test locations 330. For example, accuracy values for the estimated HRTFs may be input into the HRTF model, and the HRTF model may output a new set of estimated HRTFs. In some embodiments, each of the new set of test locations 330 may be different than each of the test locations 310. However, in some embodiments, at least one of the new set of test locations 330 may be located with at least one of the test locations 310.

The headset 300 synthesizes audio content for each of the new set of test locations 330 and presents the audio content to the user. The headset 300 monitors responses of the user to the audio content. Based on the monitored responses, the headset 300 generates a new set of estimated HRTFs and a new set of test locations. The headset 300 may iteratively refine the estimated HRTFs until a threshold accuracy is achieved, until a fixed number of iterations is reached, until a time limit is expired, or until a user input to end calibration.

Figure 4:
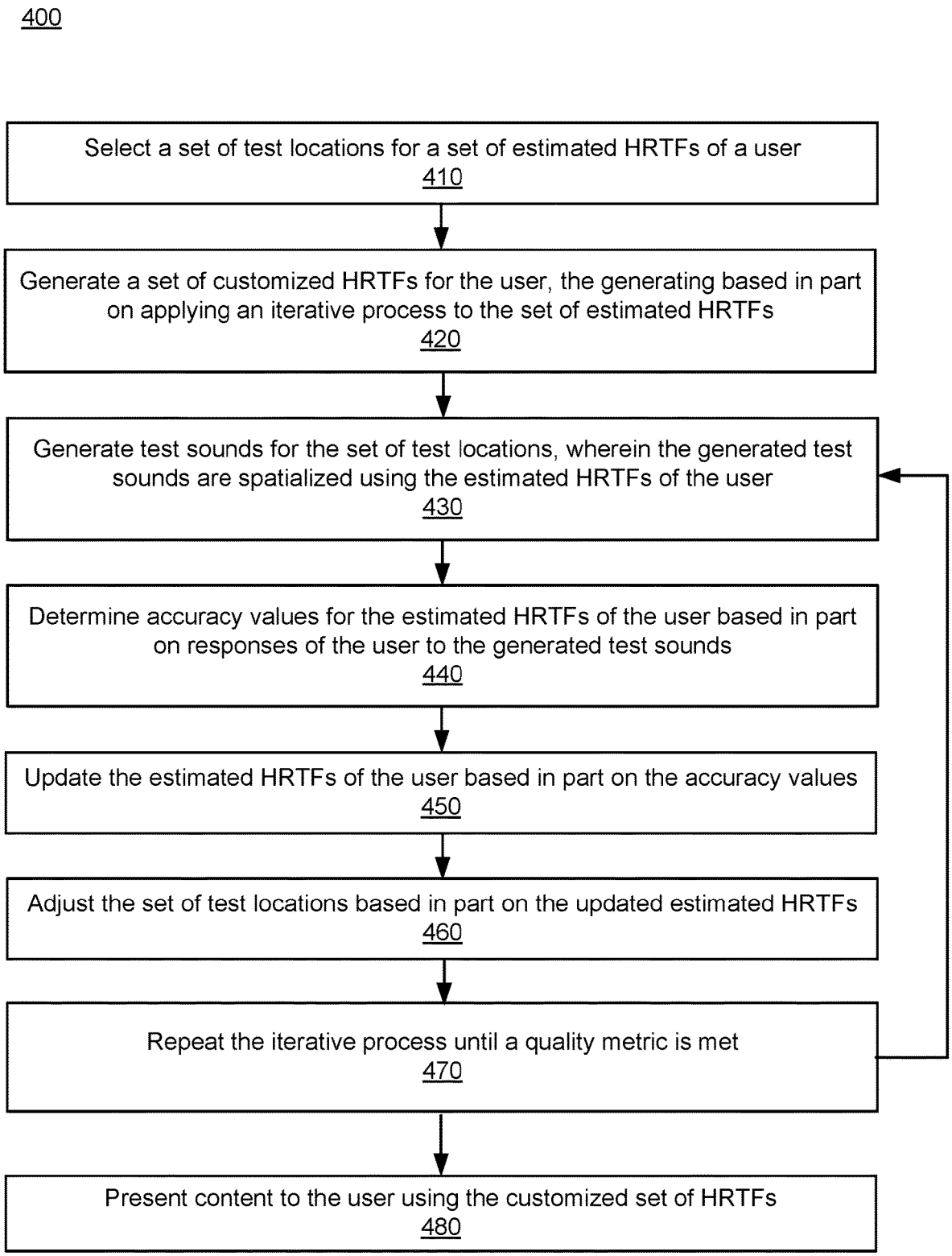
FIG. 4 is a flowchart illustrating a process for generating customized HRTFs, in accordance with one or more embodiments.

FIG. 4 is a flowchart of a method 400 of generating customized HRTFs, in accordance with one or more embodiments. The process shown in FIG. 4 may be performed by components of an audio system (e.g., audio system 200). Other entities may perform some or all of the steps in FIG. 4 in other embodiments. Embodiments may include different and/or additional steps, or perform the steps in different orders.

The audio system selects 410 a set of test locations for a set of estimated HRTFs of a user. The set of estimated HRTFs of the user may be generated locally on a headset, or received from an online system, such as an HRTF machine learning and computer vision module. The set of test locations may be selected such that a greater density of test locations is selected in areas where the estimated HRTFs differ relatively greatly as a function of angle.

The audio system generates 420 a set of customized HRTFs for the user, the generating based in part on applying an iterative process to the set of estimated HRTFs. The iterative process is described below and includes steps 430-480.

The audio system generates 430 test sounds for the set of test locations. The audio system may instruct the transducer array to generate the test sounds. The generated test sounds are spatialized using the estimated HRTFs of the user.

The audio system determines 440 accuracy values for the estimated HRTFs of the user based in part on responses of the user to the generated test sounds. The responses of the user may be detected using sensors on the headset, such as by an eye tracking unit detecting a gaze location of the user. For example, if the user perceives the generated test sound to emanate from a perceived location that is different than the test location, the difference in locations indicates an inaccuracy in the HRTF for the test location.

For active calibration, the audio system may instruct the user to perform a response, such as to look or point at the perceived direction of a sound. For passive calibration, the audio system may detect the response of a user looking or pointing at a perceived location of a sound, without providing an explicit instruction to the user to respond to the sound.

The audio system updates 450 the estimated HRTFs of the user based in part on the accuracy values. For example, the audio system may provide the accuracy values for the estimated HRTFs to a local or external HRTF model which calculates the updated HRTFs.

The audio system adjusts 460 the set of test locations based in part on the updated estimated HRTFs. For example, the audio system may select test locations in regions containing a relatively high rate of change of the updated estimated HRTFs. The adjusted set of test locations may include a greater density of test locations in regions where the system calculated greater inaccuracies in the estimated HRTFs.

The process comprises repeating 470 the iterative process until a quality metric is met. The quality metric is based in part on the accuracy values. In some embodiments, the iterative process may continue for a fixed number of iterations, a fixed amount of time, or until the audio system receives a user instruction to end the iterative process.

The process comprises presenting 480 content to the user using the customized set of HRTFs. The content may be any type of audio content presented in the normal usage of a headset. The headset may restart the HRTF customization process in response to an action such as activating the headset, or updating some system specifics, or in response to a command from the user to customize the HRTFs, or at set intervals, such as once per week or more. In some embodiments this calibration is only done once, right after the user starts the device for the first time.

Figure 5:
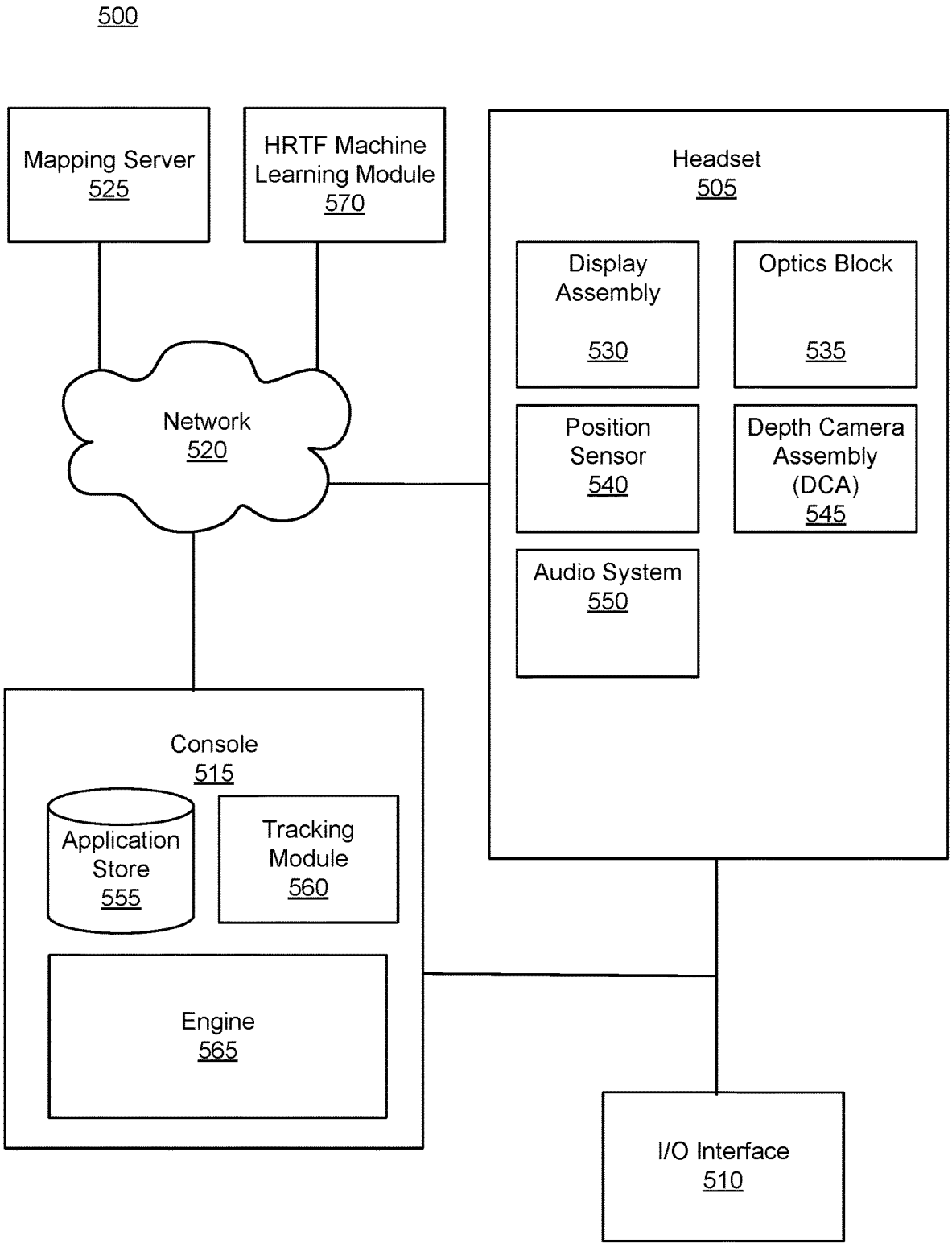
FIG. 5 is a system that includes a headset, in accordance with one or more embodiments.

FIG. 5 is a system 500 that includes a headset 505, in accordance with one or more embodiments. In some embodiments, the headset 505 may be the headset 100 of FIG. 1A or the headset 105 of FIG. 1B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. In some embodiments, the position of the headset 505 may be provided to the audio system 550 as an indication of a user response to a test sound. The position sensor 540 generates one or more measurement signals in response to motion of the headset 505. The position sensor 190 is an embodiment of the position sensor 540. Examples of a position sensor 540 include: one or more IMUs, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The audio system 550 provides audio content to a user of the headset 505. The audio system 550 is an embodiment of the audio system 200 described above. The audio system 550 may comprise one or acoustic sensors, one or more transducers, and an audio controller. The audio system 550 may provide spatialized audio content to the user. In some embodiments, the audio system 550 may request acoustic parameters from the mapping server 525 over the network 520. The acoustic parameters describe one or more acoustic properties (e.g., room impulse response, a reverberation time, a reverberation level, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the mapping server 525, and use the sound filters to provide audio content to the user.

The audio system 550 generates customized HRTFs for the user. In some embodiments, the audio system 550 may receive an initial set of estimated HRTFs from the HRTF machine learning and computer vision module 570. The audio system 550 performs an iterative process to customize the HRTFs for the user by selecting test sound locations, presenting sounds using the estimated HRTFs, and detecting user responses to the test sounds, as further described with respect to FIGS. 2-4.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. The tracking module 560 may detect a position or direction of the headset 505 in response to a test sound, such as by using an external camera to view an orientation of the headset. The tracking module 560 may transmit the detected position of the headset 505 to the audio system 550 for using in calculating accuracy values for the estimated HRTFs. In some embodiments, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The network 520 couples the headset 505 and/or the console 515 to the mapping server 525. The network 520 may include any combination of local area and/or wide area networks using both wireless and/or wired communication systems. For example, the network 520 may include the Internet, as well as mobile telephone networks. In one embodiment, the network 520 uses standard communications technologies and/or protocols. Hence, the network 520 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 520 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 520 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The mapping server 525 may include a database that stores a virtual model describing a plurality of spaces, wherein one location in the virtual model corresponds to a current configuration of a local area of the headset 505. The mapping server 525 receives, from the headset 505 via the network 520, information describing at least a portion of the local area and/or location information for the local area. The mapping server 525 determines, based on the received information and/or location information, a location in the virtual model that is associated with the local area of the headset 505. The mapping server 525 determines (e.g., retrieves) one or more acoustic parameters associated with the local area, based in part on the determined location in the virtual model and any acoustic parameters associated with the determined location. The mapping server 525 may transmit the location of the local area and any values of acoustic parameters associated with the local area to the headset 505.

The system 500 includes an HRTF machine learning and computer vision module 570. The HRTF machine learning and computer vision module 570 applies machine learning and computer vision techniques to generate an HRTF model that, when applied to data describing a user, outputs estimated HRTFs for locations relative to the user. As part of the generation of the HRTF model, the HRTF machine learning and computer vision module 570 forms a training set of HRTFs by identifying a positive training set of HRTFs that have been determined to be accurate, and, in some embodiments, forms a negative training set of HRTFs items that have been determined to be inaccurate. The HRTF model, when applied to data describing the user, such as pictures of the user's head, torso, or ears, or physical summaries or measurements of ears referred to as anthropometric features, outputs a set of estimated HRTFs for the user of the headset 505. The HRTF machine learning and computer vision module 570 receives feedback from the headset 505 describing the accuracy of the estimated HRTFs. The HRTF machine learning and computer vision module 570 uses the feedback as inputs to the HRTF model to update the HRTFs for the user. Although shown as a separate component, in some embodiments, the HRTF machine learning and computer vision module 570 may be a component of the headset 505 or the console 515, such as part of the audio system 550.

Additional Configuration Information

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A method comprising:

selecting a set of test locations based on a first set of head-related transfer functions (HRTFs) of a user and a rate of change of the first set of HRTFs within a region;

generating test sounds for the set of test locations; and calculating a second set of HRTFs for the user based on user responses to the generated test sounds.

2. The method of claim 1, wherein the first set of HRTFs are generated by an HRTF machine learning and computer vision module.

3. The method of claim 1, wherein the first set of HRTFs are generated based on data describing physical characteristics of the user.

4. The method of claim 3, wherein the data describing the user comprises an image of an ear of the user.

5. The method of claim 1, wherein the generating test sounds for the set of test locations comprises sequentially generating a test sound for each of the test locations.

6. The method of claim 5, wherein an accuracy value for an estimated HRTF is calculated based on a difference in location between the test location for the estimated HRTF and a gaze location of the user in response to the test sound for the test location.

7. The method of claim 1, further comprising:

selecting a second set of test locations;

generating test sounds for the second set of test locations; and calculating a third set of HRTFs for the user based on user responses to the generated test sounds at the second set of test locations.

8. A method comprising:

selecting a first set of test locations based on a first set of estimated head-related transfer functions (HRTFs) of a user and a rate of change of the first set of HRTFs within a region;

generating test sounds for the first set of test locations;

calculating accuracy values for the first set of estimated HRTFs of the user; and calculating a second set of HRTFs for the user based on the accuracy values for the first set of estimated HRTFs.

9. The method of claim 8, wherein the first set of estimated HRTFs are generated by an HRTF machine learning and computer vision module.

10. The method of claim 8, wherein the first set of estimated HRTFs are generated based on data describing physical characteristics of the user.

11. The method of claim 10, wherein the data describing the user comprises an image of an ear of the user.

12. The method of claim 8, wherein the generating test sounds for the set of test locations comprises sequentially generating a test sound for each of the test locations.

13. The method of claim 12, wherein an accuracy value for an estimated HRTF is calculated based on a difference in location between the test location for the estimated HRTF and a gaze location of the user in response to the test sound for the test location.

14. The method of claim 8, further comprising:

selecting a second set of test locations based on the second set of HRTFs; and generating test sounds for the second set of test locations.

15. A computer program product comprising a non-transitory computer-readable storage medium containing computer program code for:

selecting a set of test locations based on a first set of head-related transfer functions (HRTFs) of a user and a rate of change of the first set of HRTFs within a region;

generating test sounds for the set of test locations; and calculating a second set of HRTFs for the user based on user responses to the generated test sounds.

16. The computer program product of claim 15, wherein the set of HRTFs are generated by an HRTF machine learning and computer vision module.

17. The computer program product of claim 15, wherein the set of HRTFs are generated based on data describing physical characteristics of the user.

18. The computer program product of claim 17, wherein the data describing the user comprises an image of an ear of the user.

19. The computer program product of claim 15, wherein the generating test sounds for the set of test locations comprises sequentially generating a test sound for each of the test locations.

20. The computer program product of claim 19, wherein an accuracy value for an HRTF is calculated based on a difference in location between the test location for the HRTF and a gaze location of the user in response to the test sound for the test location.

* * * * *